US008073369B2

(12) United States Patent
Shimada

(10) Patent No.: US 8,073,369 B2
(45) Date of Patent: Dec. 6, 2011

(54) DEVELOPMENT DEVICE TRANSFERRING ONLY A TONER LAYER TO A DEVELOPING ROLLER AND IMAGE APPARATUS USING THE SAME

(75) Inventor: Akira Shimada, Hitachinaka (JP); Tomomi Shimada, legal representative, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 705 days.

(21) Appl. No.: 12/177,662

(22) Filed: Jul. 22, 2008

(65) Prior Publication Data

US 2009/0190970 A1 Jul. 30, 2009

(30) Foreign Application Priority Data

Jul. 23, 2007 (JP) ..... 2007-190682

(51) Int. Cl.
*G03G 15/08* (2006.01)

(52) U.S. Cl. ..... 399/281; 399/282; 399/285

(58) Field of Classification Search ..... 399/281, 399/282, 285
See application file for complete search history.

(56) References Cited

U.S. PATENT DOCUMENTS

| | | | | |
|---|---|---|---|---|
| 3,866,574 | A | 2/1975 | Hardennrook et al. | |
| 3,929,098 | A | 12/1975 | Liebman | |
| 5,495,322 | A * | 2/1996 | Wada et al. | 399/285 |
| 5,666,625 | A * | 9/1997 | Komatsubara et al. | 399/281 |
| 5,734,952 | A | 3/1998 | Murakami et al. | |
| 5,832,350 | A * | 11/1998 | Kumasaka et al. | 399/282 |
| 5,995,789 | A | 11/1999 | Murakami et al. | |

FOREIGN PATENT DOCUMENTS

| | | | |
|---|---|---|---|
| JP | 55-77764 | A | 6/1980 |
| JP | 3-113474 | A | 5/1991 |
| JP | 7-160112 | A | 6/1995 |
| JP | 2000-250305 | A | 9/2000 |
| JP | 3356948 | B2 | 10/2002 |
| JP | 3404713 | B2 | 3/2003 |

* cited by examiner

*Primary Examiner* — David Gray
*Assistant Examiner* — Laura Roth
(74) *Attorney, Agent, or Firm* — Crowell & Moring LLP

(57) ABSTRACT

A development device includes a developing roller composed of an elastic body. An intermediate roller made of metal is disposed closely to the developing roller so as to face the developing roller. A magnetic roller is disposed closely to the intermediate roller so as to face the intermediate roller. A developer layer composed of a magnetic carrier and a toner is formed on the surface of the magnetic roller. The developer layer is carried to the intermediate roller side, and only the toner in the developer layer is transferred to the intermediate roller. A toner layer formed thus is transferred from the intermediate roller to the developing roller, and brought into contact with the surface of an image carrying member.

20 Claims, 8 Drawing Sheets

DEVELOPMENT DEVICE TRANSFERRING ONLY A TONER LAYER TO A DEVELOPING ROLLER AND IMAGE APPARATUS USING THE SAME

FIELD OF THE INVENTION

The present invention relates to a development device for use in an image forming apparatus such as a copying machine, a printer, a facsimile machine or a complex machine combining each function of those, and particularly relates to a development device based on a hybrid development system where a binary developer using a magnetic carrier for charging a non-magnetic toner is used and only the charged toner is retained on a developing roller and brought into contact with an electrostatic latent image so as to develop the latent image, and an image forming apparatus using the development device.

BACKGROUND OF THE INVENTION

Image forming apparatus using electrophotographic systems, such as copying machines, printers, facsimile machines or complex machines combining each function of those, have used various development systems such as a binary development system, a monocomponent development system, a hybrid development system, etc. The binary development system uses a toner and a magnetic carrier while the monocomponent development system uses only a toner as a developer. The hybrid development system uses a binary developer using a magnetic carrier for charging a non-magnetic toner. In the hybrid development system, only the charged toner is retained on a developing roller and brought into flight to or contact with an electrostatic latent image so as to develop the latent image.

The binary development system is superior in the electrostatic property of the toner due to the carrier and capable of extending the life of the apparatus. In addition, the binary development system is advantageous in equalizing a solid image. However, the binary development system has drawbacks as follows. That is, (1) the binary development system requires a large and complicated development device; (2) toner flying or carrier drawing may occur; and (3) the quality of an image may be shifted in accordance with the durability of the carrier.

The monocomponent development system can use a compact development device and is superior in dot reproducibility. However, the monocomponent development system has drawbacks as follows. That is, (1) due to the durability lowered by the deterioration of a developing roller, the development device must be replaced to increase the expenses of supplies; and (2) selective development may occur. On the other hand, the hybrid development system is a system which combines the binary development system and the monocomponent development system. The hybrid development system is superior in dot reproducibility and capable of extending the life of the apparatus and forming an image at a high speed.

One of the background-art techniques as to hybrid development is disclosed in U.S. Pat. No. 3,866,574. According to the technique, a thin layer is formed out of a non-magnetic toner on a donor roller (developing roller) placed in non-contact with an image carrying member, and the toner is made to fly to a latent image on the image carrying member by an AC electric field. U.S. Pat. No. 3,929,098 discloses a development device in which a developer is carried to a donor roller by a magnetic roller, and a toner is transferred onto the donor roller so as to form a toner layer.

According to these techniques, a thin layer can be formed on a donor roller by use of a binary developer. It is, however, difficult to separate a toner on the donor roller when the toner is highly charged. Thus, a high AC electric field is required. The electric field disturbs a toner layer on an image carrying member so as to cause trouble for color layering or the like. As a solution to the trouble, JP-A-3-113474 discloses a so-called powder cloud development method in which an auxiliary electrode composed of wires is placed between a donor roller and an image carrying member, and a weak AC current is applied to the auxiliary electrode so as to prevent a developed toner from being disturbed.

These background-art techniques are based on non-contact development using a hybrid development system. The non-contact development has problems as follows. That is, it is necessary to keep a gap between a photoconductor and a developing roller on the order of several tens of micrometers and with a high precision. In addition, an AC current has to be applied to the developing roller. As a result, the configuration of a development device is complicated, and fine dot images or gradations cannot be reproduced satisfactorily.

On the other hand, contact development apparatus using a hybrid development system have been proposed as follows. JP-A-55-77764 discloses a method of contact development using a sponge roller as a developing roller. Japanese Patent No. 3356948 or Japanese Patent No. 3404713 discloses a method of contact development using a developing roller composed of an elastic roller fitted into a metal sleeve.

In some electrophotographic image forming apparatus, a photoconductor whose substrate is composed of a metal drum is used as a member for forming an electrostatic latent image. Generally in such an image forming apparatus, a developing roller composed of an elastic body such as rubber or sponge has to be pressed onto the photoconductor at a constant pressure in order to secure a developing range where the developing roller can come in contact with the photoconductor so as to carry out stable development. However, the developing roller composed of rubber, sponge or the like has a problem as follows. That is, the developing roller is vulnerable to sliding on a control member such as a blade, or vulnerable to abrasion with a binary developer using a magnetic carrier.

The aforementioned Japanese Patent No. 335694 and Japanese Patent No. 3404713 are solutions to the problem. However, each solution has a problem as follows. That is, the photoconductor is rubbed by the metal sleeve so that the surface of the photoconductor may be easily damaged, or the metal sleeve is separated from the elastic roller so that a long life cannot be given to the developing roller.

Patent Document 1: U.S. Pat. No. 3,866,574
Patent Document 2: U.S. Pat. No. 3,929,098
Patent Document 3: JP-A-3-113474
Patent Document 4: JP-A-55-77764
Patent Document 5: Japanese Patent No. 3356948
Patent Document 6: Japanese Patent No. 3404713

As described above, in order to achieve contact development in a background-art development device using a hybrid development system, a developing roller which will come in contact with a photoconductor has to be composed of an elastic body. However, in a process where the developing roller composed of an elastic body is rubbed by a binary developer composed of a magnetic carrier and a toner so that a predetermined quantity of the toner is applied to the surface of the developing roller, the surface of the developing roller is abraded and roughed by the binary developer. Thus, the toner is applied to the surface of developing roller unevenly. As a result, the life of the developing roller is apt to be shortened.

A method using a developing roller in which a metal sleeve is fitted to the surface of an elastic roller also has problems as follows. That is, a photoconductor is rubbed by the metal sleeve so that the surface of the photoconductor is easily damaged, or the metal sleeve is separated from the elastic roller. It is therefore difficult to elongate the life of the developing roller.

SUMMARY OF THE INVENTION

An object of the present invention is to solve the foregoing problems. Another object of the present invention is to provide a hybrid type development device in which abrasion of a developing roller is reduced to elongate the life of the device so that high-speed and high-quality images can be obtained stably over a long time. Another object of the present invention is to provide an image forming apparatus using the hybrid type development device.

In order to attain the foregoing objects, a first configuration of the present invention provides a development device including: a binary developer composed of a magnetic carrier and a toner; a developing roller for applying the toner to an electrostatic latent image formed on a surface of an image carrying member so as to develop the electrostatic latent image, at least a surface layer of the developing roller being made of an elastic body; an intermediate roller made of metal and disposed closely to the developing roller so as to face the developing roller; and a magnetic roller disposed closely to the intermediate roller so as to face the intermediate roller; wherein:

the magnetic roller is rotated in contact with the binary developer so that a developer layer made of a mixture of the magnetic carrier and the toner is formed on a surface of the magnetic roller; the developer layer is carried toward the intermediate roller made of metal so that only the toner of the developer layer is transferred to the intermediate roller so as to form a toner layer; and with rotation of the intermediate roller and the developing roller, the toner layer is transferred from the intermediate roller to the developing roller, and the toner layer on the developing roller is brought into contact with the surface of the image carrying member.

According to a second configuration of the present invention, the development device according to the first configuration is characterized in that irregularities are formed in a surface of at least one of the magnetic roller and the intermediate roller.

According to a third configuration of the present invention, the development device according to the first configuration is characterized by further including a first bias power supply connected to the magnetic roller, a second bias power supply connected to the intermediate roller, and a third bias power supply connected to the developing roller, wherein:

an electric field acting in a direction in which only the toner of the developer layer formed on the magnetic roller is transferred to the intermediate roller is formed by a potential difference between the first bias power supply and the second bias power supply; and an electric field acting in a direction in which the toner formed on the intermediate roller is transferred to the developing roller is formed by a potential difference between the second bias power supply and the third bias power supply.

According to a fourth configuration of the present invention, the development device according to the first configuration is characterized in that a relation of $v_{mid}>v_{dev}$ is established between a peripheral velocity $v_{mid}$ of the intermediate roller and a peripheral velocity $v_{dev}$ of the developing roller.

According to a fifth configuration of the present invention, the development device according to the first configuration is characterized in that:

a quantity Tm of the toner is applied onto the intermediate roller, and the intermediate roller is rotated in contact with the developing roller so as to transfer the toner on the intermediate roller to the developing roller, so that a toner layer of a toner deposit quantity Td is formed on the developing roller; and a relation of $Td \approx (v_{mid}/v_{dev}) \cdot Tm$ is established among a peripheral velocity $v_{mid}$ of the intermediate roller, a peripheral velocity $v_{dev}$ of the developing roller and the quantity Tm of the toner applied onto the intermediate roller, so as to obtain the predetermined toner deposit quantity Td on the developing roller.

According to a sixth configuration of the present invention, the development device according to the first configuration is characterized by further including a control member provided in opposition to a periphery of the magnetic roller so as to control a thickness of the developer layer on the magnetic roller.

According to a seventh configuration of the present invention, the development device according to the first configuration is characterized in that indentation of the developing roller on the intermediate roller is controlled to be not shallower than 0.1 mm.

An eighth configuration of the present invention provides an image forming apparatus including: a photoconductor; a charging unit for charging a surface of the photoconductor uniformly; an exposure unit for irradiating the charged surface of the photoconductor with light so as to form an electrostatic latent image thereon; a development device for supplying a toner onto the photoconductor where the electrostatic latent image is formed, so as to develop the electrostatic latent image into a toner image; a transfer unit for transferring the toner image formed on the photoconductor by the development device to a recording medium; and a fixing unit for fixing the transferred toner image onto the recording medium; wherein the development device is a development device according any one of the first to seventh configurations.

According to a ninth configuration of the present invention, the image forming apparatus according to the eighth configuration is characterized in that a relation of $v_{dev}>v_{pc}$ is established between a peripheral velocity $v_{dev}$ of the developing roller and a peripheral velocity $v_{pc}$ of the photoconductor.

According to a tenth configuration of the present invention, the image forming apparatus according to the ninth configuration is characterized in that a relation of $v_{mid}>v_{dev}>v_{pc}$ is established among a peripheral velocity $v_{mid}$ of the intermediate roller, the peripheral velocity $v_{dev}$ of the developing roller and the peripheral velocity $v_{pc}$ of the photoconductor.

According to an eleventh configuration of the present invention, the image forming apparatus according to the eighth configuration is characterized in that a relation of $v_{dev}<v_{pc}$ is established between a peripheral velocity $v_{dev}$ of the developing roller and a peripheral velocity $v_{pc}$ of the photoconductor.

According to a twelfth configuration of the present invention, the image forming apparatus according to the eleventh configuration is characterized in that a relation of $v_{dev}<v_{mid}<v_{pc}$ is established among a peripheral velocity $v_{mid}$ of the intermediate roller, the peripheral velocity $v_{dev}$ of the developing roller and the peripheral velocity $v_{pc}$ of the photoconductor.

According to a thirteenth configuration of the present invention, the image forming apparatus according to the twelfth configuration is characterized in that in order to obtain a maximum value Tpc(max) of a quantity of the toner applied to the electrostatic latent image on the photoconductor, a relation of $Tpc(max) \approx (v_{dev}/v_{pc}) \cdot Td$ is established among the peripheral velocity $v_{dev}$ of the developing roller, the peripheral velocity $v_{pc}$ of the photoconductor and a toner deposit quantity Td on the developing roller.

According to a fourteenth configuration of the present invention, the image forming apparatus according to any one of the eighth to thirteenth configurations is characterized in that the development device includes a plurality of development units which are loaded with toners of different colors individually, so that a color image can be formed.

According to the present invention, the developing roller at least a surface layer of which is composed of an elastic body can be prevented from being rubbed directly by a binary developer including a carrier. In addition, a stable toner layer can be formed on the intermediate roller and the developing roller. It is therefore possible to extend the life of the development device and to obtain high-speed and high-quality images stably over a long time.

DETAILED DESCRIPTION OF THE EMBODIMENTS

Embodiments of the present invention will be illustratively described below with reference to the drawings.

First Embodiment

Figure 1:
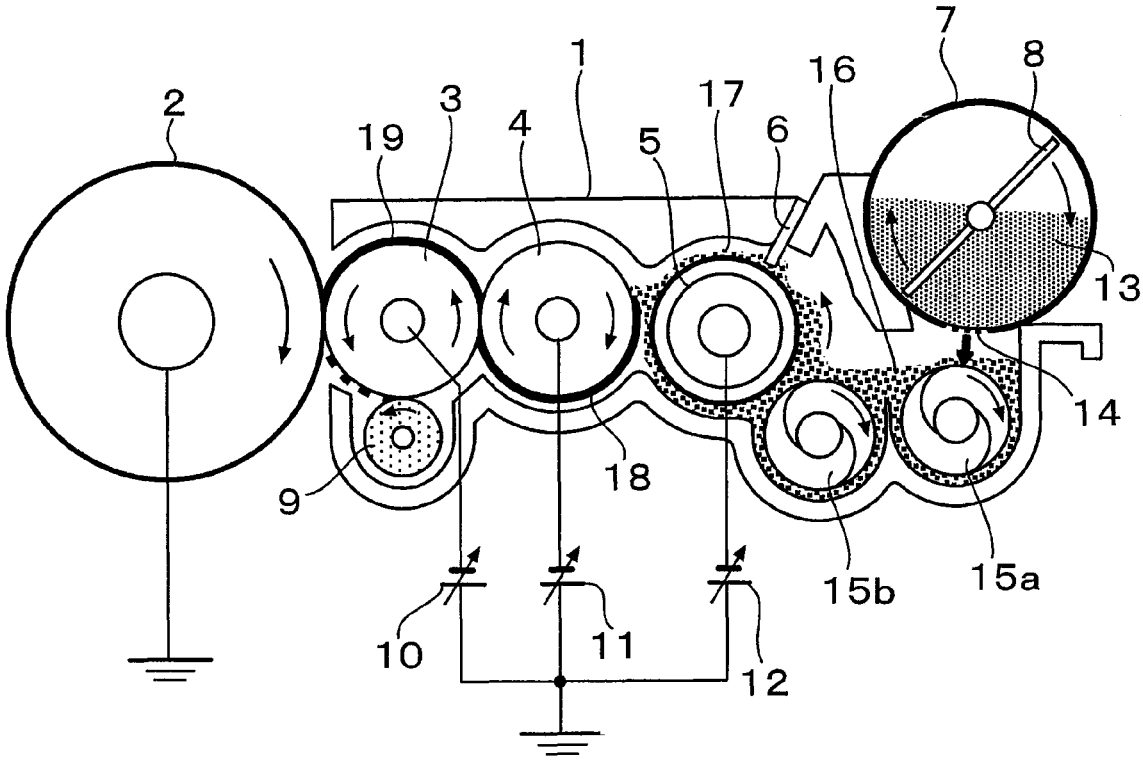
FIG. 1 is a schematic side view of a development device according to a first embodiment of the present invention.

FIG. 1 is a schematic side view of a development device according to a first embodiment of the present invention. As shown in FIG. 1, a development device 1 has a developing roller 3, an intermediate roller 4, a magnetic roller 5, a control plate 6, stirring blades 8 provided in a toner hopper 7, a reset roller 9, bias power supplies 10, 11 and 12, developer stirring screws 15*a* and 15*b*, etc.

The developing roller 3 is disposed closely to a photoconductor 2 so as to face the photoconductor 2. The intermediate roller 4 is disposed closely to the developing roller 3 so as to face the developing roller 3 on the opposite side to the photoconductor 2. The magnetic roller 5 is disposed closely to the intermediate roller 4 so as to face the intermediate roller 4 on the opposite side to the developing roller 3. The developing roller 3, the intermediate roller 4 and the magnetic roller 5 are substantially lined up. The reset roller 9 is disposed below the developing roller 3 closely thereto.

A toner 13 in the toner hopper 7 is thrown through an opening 14 onto a developer 16 on the screw 15*a* side of the developer stirring screws 15*a* and 15*b* by the stirring blades 8. The developer 16 is composed of two components, that is, a magnetic carrier and a toner. The toner 13 thrown from the inside of the toner hopper 7 is mixed and stirred with the developer 16 by the rotation of the developer stirring screws 15*a* and 15*b*. Thus, the toner density of the developer 16 is uniformized while the magnetic carrier and the toner are charged with polarities reverse to each other by triboelectrification.

The magnetic roller 5 is constituted by a fixed magnet roller (magnet body) and a sleeve rotating around the magnet roller concentrically therewith. The sleeve rotates counterclockwise. With this rotation, the developer 16 is attracted onto the peripheral surface of the magnetic roller 5, and moves counterclockwise in the same direction as the sleeve rotates. The developer 16 moving counterclockwise with the rotation of the magnetic roller 5 is controlled and formed into a developer layer 17 of a predetermined thickness by the control plate 6 provided oppositely to the periphery of the magnetic roller 5.

An excess outside part of the developer 16 scraped by the control plate 6 turns back along the wall in the development device 1. The developer 16 brought back to the developer stirring screw 15*b* side again is stirred by the rotation of the developer stirring screws 15*a* and 15*b*.

The developer layer 17 controlled and formed on the peripheral surface of the magnetic roller 5 by the control plate 6 is brought into contact with the intermediate roller 4 which is rotating clockwise. At the same time, an electric field is applied between the magnetic roller 5 and the intermediate roller 4. Thus, a toner layer 18 is formed on the periphery of the intermediate roller 4.

That is, the magnetic carrier and the toner composing the developer 16 retained on the magnetic roller 5 are charged with polarities reverse to each other by triboelectrification. When the electric field is applied between the magnetic roller 5 and the intermediate roller 4, only the toner in the developer 16 adheres onto the periphery of the intermediate roller 4 so as to form the toner layer 18.

After that, the intermediate roller 4 together with the toner layer 18 formed on the intermediate roller 4 is brought into contact with the developing roller 3 rotating counterclockwise while a difference in peripheral velocity is secured therebetween. At the same time, an electric field is applied between the intermediate roller 4 and the developing roller 3. Thus, the toner layer 18 formed on the intermediate roller 4 is transferred onto the developing roller 3 so as to form a designated toner layer 19 on the periphery of the developing roller 3. The electric field between the magnetic roller 5 and the intermediate roller 4 and the electric field between the intermediate roller 4 and the developing roller 3 are formed by the bias power supplies 10, 11 and 12.

Next, by the rotation of the developing roller 3, the toner layer 19 on the developing roller 3 is carried to a section (developing section) opposite to the photoconductor 2 and brought into contact with the photoconductor 2. At the same time, a developing electric field is applied to the developing section so as to develop an electrostatic latent image on the photoconductor 2. Thus, a toner image is formed on the surface of the photoconductor 2. After the contact with the photoconductor 2, the toner layer 19 on the developing roller 3 is partially scraped or smoothed by the reset roller 9 rotating in contact with the developing roller 3.

When the particle size of the magnetic carrier used in the developer 16 is longer than 100 μm, unevenness like brush marks will be conspicuous in the toner layer 18 on the intermediate roller 4. When the particle size is not longer than 40 μm, there will be shown a tendency to increase the deposit of the magnetic carrier. Therefore, a mixture of a magnetic carrier whose particle size is 50-100 μm and a toner whose particle size is 5-11 μm can serve as the developer 16.

In this embodiment, it will go well if the toner density (Wt %: toner weight×100/magnetic carrier weight) of the developer layer 17 on the magnetic roller 5 having passed through the control plate 6 is established in a range of from 3 Wt % to 25 Wt % in consideration of the electrification quantity of the toner or the amount of transportation of the developer. More preferably, the toner density of the developer 16 in a stirring/mixing chamber is designed to be able to be kept higher than the toner density of the developer layer 17 having passed through the control plate 6. As a result, the toner density of the developer layer 17 having passed through the control plate 6 can reach a saturated toner density (in a range of from 7 Wt % to 25 Wt %) which is determined in accordance with the toner particle size and the magnetic carrier particle size.

Here, the saturated toner density can be measured as follows. That is, the developer 16 is prepared with an enough high toner density (about 15 Wt %). After the developer 16 is thrown in, the sleeve of the magnetic roller 5 is rotated to allow the developer layer 17 to pass through the control plate 6. The toner density of the developer layer 17 having passed through the control plate 6 is measured as the saturated toner density.

It can be considered that the toner density of the developer layer 17 having passed through the control plate 6 shows a saturated value for the following reason. That is, the maximum quantity of a toner that can be carried when the developer layer 17 passes through the control plate 6 can be estimated to be the quantity of a toner that can be attracted onto the magnetic carrier surface by electrostatic force, that is, to be about 1-3 layers. Even if a more quantity of the toner is retained in gaps of the magnetic carrier or the toner, the toner can be expected to leave the gaps due to the effect of oscillation of a magnetic brush, electrostatic force acting between the magnetic brush and the control plate 6, etc. when the magnetic brush rotates or passes through the control plate 6.

It can be therefore considered that there is a limit in the quantity of a toner that can be carried, and the value of the limit corresponds to the saturated toner density. Accordingly, there is an advantage that the mixing ratio in the developer layer 16 can be kept stable without placing any toner density detection sensor (or without complicating the device configuration) if the toner density of the developer layer 17 having passed through the control plate 6 is set as the saturated value.

Ferrite, magnetite, iron powder, etc. are suitable for the material of the magnetic carrier. In the system according to this embodiment, a toner layer is once formed on the intermediate roller 4. It is therefore possible to use more comprehensive magnetic carriers than in a widely-used system where a latent image on a photoconductor is developed directly with a binary developer. Thus, it is proved that a resin carrier as well as the aforementioned metal-based magnetic carrier can be used. As for a ferrite carrier, a substantially spherical one whose bulk specific gravity is 2.2-2.7 g/cm$^3$ and whose saturation magnetization is 30-95 emu/g can be used. As for a resin carrier, a spherical or irregular one whose bulk specific gravity is 1.0-1.6 g/cm$^3$ and whose saturation magnetization is 60-80 emu/g can be used.

The toner has polyester resin as its base. A pigment serving as a color material, a charge control agent for controlling a charging state, and a mold release agent for supporting releasability in a fixing process are adequately mixed with the polyester resin base, kneaded, crushed and classified into a predetermined particle size. After that, external additives such as silica, alumina, etc. are added. Alternatively, in the system according to this embodiment, a toner using styrene acrylic resin or the like may be used in the same manner.

The magnetic roller 5 is constituted by a sleeve and a magnet roller as described previously. Of them, the sleeve is a cylinder made of metal such as stainless steel. The surface of the cylinder is roughed to about 0.3-1.5 in roughness Ra by sandblasting or the like so as to form fine irregularities in order to improve the performance of carrying the developer 16. Alternatively, a roller with a sleeve whose metal surface has irregularities such as grooves or ribs arranged perpendicularly to the circumferential direction and at an equal interval may be also used. The magnet roller disposed fixedly in the sleeve has four magnetic poles, each of which has been magnetized in a magnetic power range of 400-1,200 gausses. The ratio of the peripheral velocity $v_{mag}$ of the sleeve of the magnetic roller 5 to the peripheral velocity $v_{mid}$ of the intermediate roller 4 is set in a range of 1.0-5.0.

The control plate 6 has a gap a between the control plate 6 and the magnetic roller 5. The gap a is adjusted to control the throughput of the developer 16 pumped up onto the magnetic roller 5 by the rotation of the magnetic roller 5. Thus, the developer layer 17 of a predetermined thickness is formed on the magnetic roller 5. In this embodiment, it is desired that the gap a is in a range of 0.3-0.8 mm.

The intermediate roller 4 is made of stainless steel or iron plated with nickel or made of metal such as aluminum. The surface of the intermediate roller 4 is roughed to about 0.2-1.5 in surface roughness Ra by sandblasting or the like so as to form fine irregularities in order to improve the performance of carrying a toner layer. A predetermined gap b (0.3-1.5 mm, preferably 0.3-0.5 mm) is kept between the magnetic roller 5 and the intermediate roller 4. Only the toner of the developer layer 17 on the magnetic roller 5 is moved to the intermediate roller 4 by an electric field generated by the potential difference between the bias power supply 11 and the bias power supply 12. Thus, a toner layer 18 of a predetermined thickness is formed on the intermediate roller 4. At this time, the potential difference between the bias power supply 11 and the bias power supply 12 is in a range of from 200 V to 1,000 V, and the absolute value of the bias power supply 12 is set to be larger than that of the bias power supply 11. Due to an electric field generated by the potential difference, the toner layer 18 of a predetermined thickness is formed on the intermediate roller 4.

Figure 2:
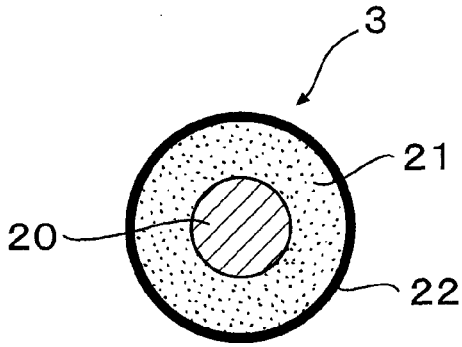
FIG. 2 is a sectional view of a developing roller used in the development device.

The developing roller 3 has a metal core 20 as its base. As shown in FIG. 2, the metal core 20 is provided with an elastic layer 21 and a surface layer 22. The elastic layer 21 is composed of urethane rubber mixed with a conductive agent such as carbon and adjusted to have a resistance of $10^6$-$10^{10}$ Ωcm.

The hardness of the elastic layer 21 is 40-70° in Asker-C. The surface layer 22 is composed of urethane rubber adjusted to have the same resistance value in the same manner. The hardness of the surface layer 22 is 70-90° in Asker-C. The surface roughness of the surface layer 22 is 2-9 μm in Rz.

The elastic layer 21 serves to adjust electric resistance as well as to secure elasticity. The surface layer 22 serves not only to secure the performance of carrying a toner but also to secure abrasion proof and protect the photoconductor 2 from abrasion so as to give a longer life to the developing roller 3.

In this embodiment, such a roller having a two-layer structure is used as the developing roller 3. As for the material of the developing roller 3, a conductive agent such as carbon is mixed with rubber such as urethane or silicone so as to adjust the resistance to $10^6$-$10^{10}$ Ωcm. Another roller can be used in the same manner if the roller has similar resistance, similar hardness and similar surface roughness to those of the aforementioned developing roller 3.

Figure 3:
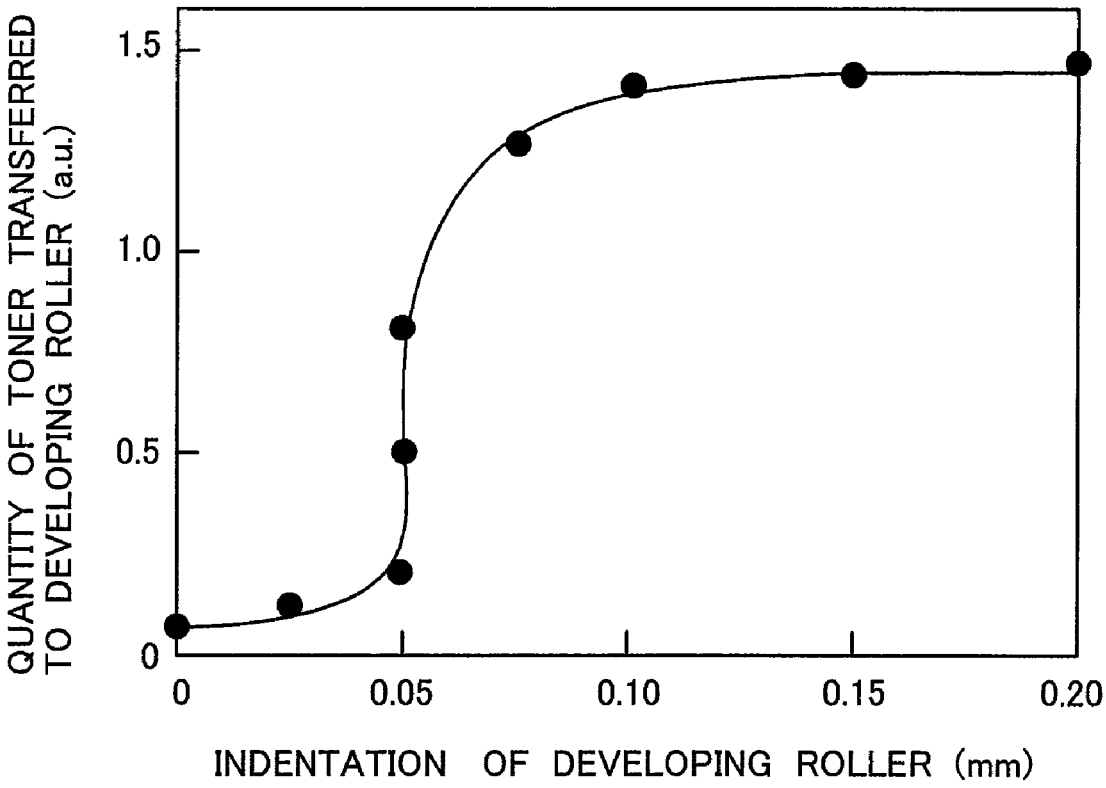
FIG. 3 is a characteristic graph showing the relationship between the indentation of the developing roller on an intermediate roller and the quantity of a toner transferred from the intermediate roller to the developing roller.

FIG. 3 is a characteristic graph showing the relationship between the indentation of the developing roller 3 when the developing roller 3 was brought into contact with the intermediate roller 4 so as to be indented and the quantity of a toner transferred from the intermediate roller 4 to the developing roller 3 in the development device according to this embodiment. In this time, a potential difference appropriate to transferring the toner was provided between the developing roller 3 and the intermediate roller 4.

It is proved from this result that the quantity of the transferred toner is stabilized when the indentation of the developing roller 3 is set to be not smaller than 0.1 mm. On the other hand, when the indentation is increased, the frictional force between the developing roller 3 and the intermediate roller 4 increases so that the torque to drive the both increases. In this embodiment, therefore, the indentation of the developing roller 3 on the intermediate roller 4 is suitable in a range of 0.1-0.3 mm.

A closed cell type sponge roller made of urethane is used as the reset roller 9 in this embodiment. It is preferable that the porosity is 50-70 pores per inch, and the hardness is 60-90° in Asker-F. The indentation of the reset roller 9 on the developing roller 3 is preferably not smaller than 0.1 mm in view of the reset property of a toner on the developing roller 3. When the indentation is increased, the driving torque increases in the same manner as the above-mentioned torque when the indentation between the intermediate roller 4 and the developing roller 3 is increased. It is therefore preferable that the indentation between the reset roller 9 and the developing roller 3 is in a range of 0.1-0.3 mm.

Figure 4:
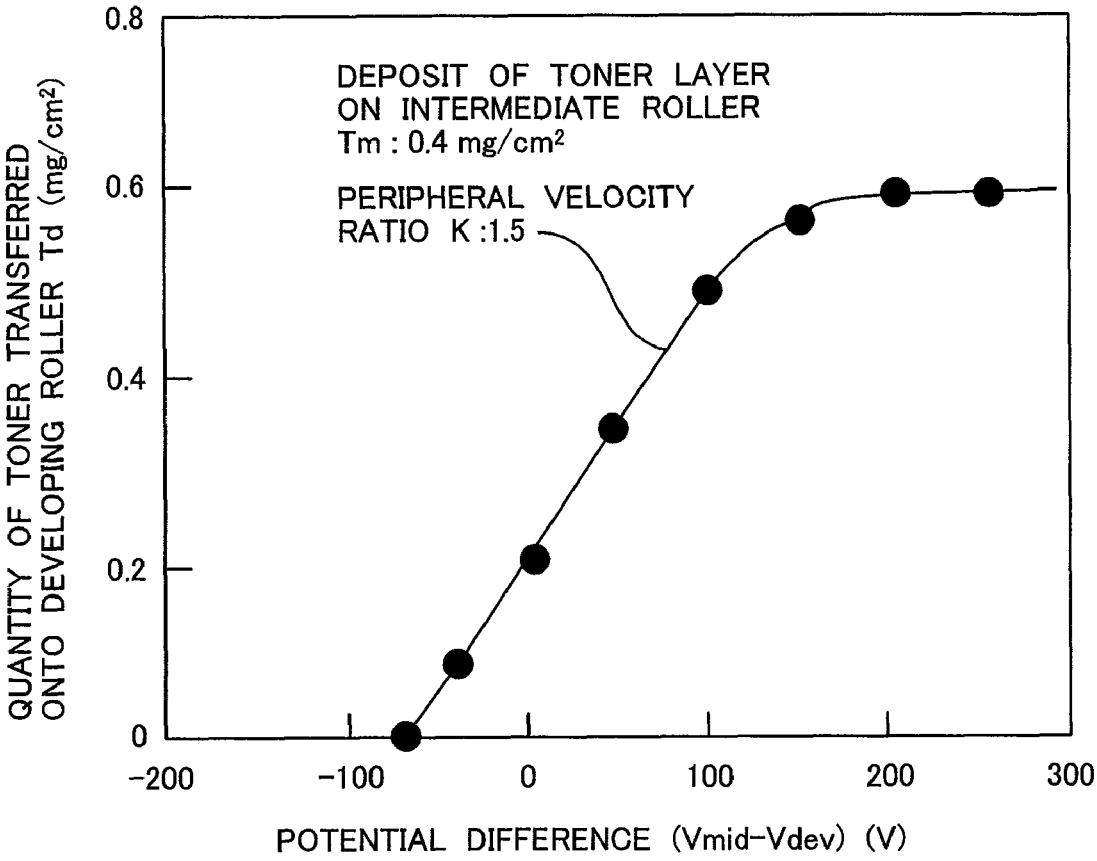
FIG. 4 is a characteristic graph showing the relationship between the potential difference between the bias voltage of the intermediate roller and that of the developing roller and the quantity of a toner transferred from the intermediate roller to the developing roller.

FIG. 4 is a characteristic graph showing the quantity with which the toner layer 18 on the intermediate roller 4 could be transferred to the developing roller 3 in accordance with the potential difference (Vmid−Vdev) between the voltage Vmid of the bias power supply 11 connected to the intermediate roller 4 and the voltage Vdev of the bias power supply 10 connected to the developing roller 3 in the development device 1 according to this embodiment. In this experiment, the ratio of the peripheral velocity $v_{mid}$ of the intermediate roller 4 to the peripheral velocity $v_{dev}$ of the developing roller 3 (intermediate roller peripheral velocity $v_{mid}$/developing roller peripheral velocity $v_{dev}$=peripheral velocity ratio K1) was set at 1.5.

It is proved from this result that almost all the toner layer 18 on the intermediate roller 4 can be transferred to the developing roller 3 when the potential difference (Vmid−Vdev) is set to be not lower than 200 V. In this embodiment, therefore, the potential difference is set at 250 V.

Figure 5:
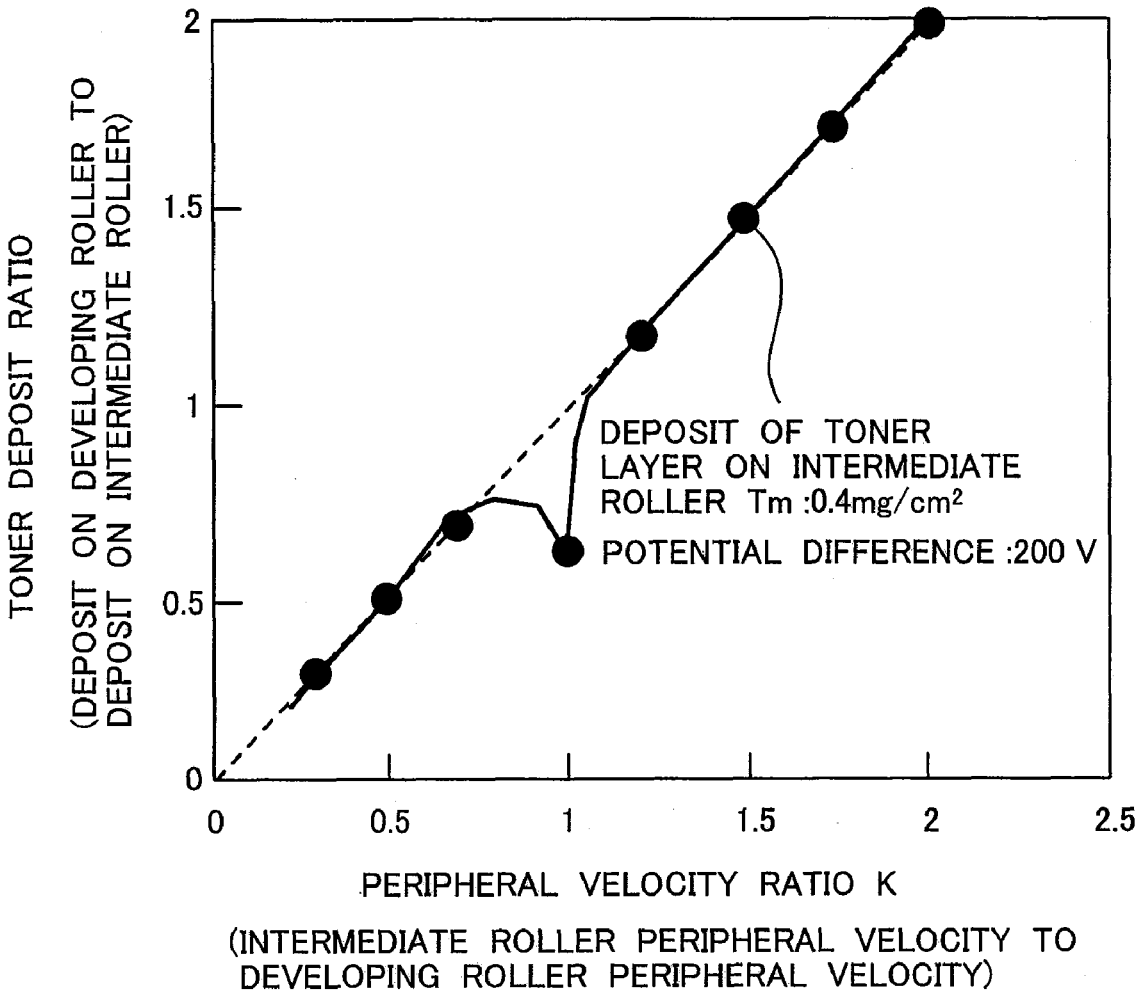
FIG. 5 is a characteristic graph showing the relationship between the ratio of the peripheral velocity of the intermediate roller to that of the developing roller and the ratio of the toner deposit quantity on the developing roller to that on the intermediate roller.

FIG. 5 is a characteristic graph showing the ratio (Td/Tm) of the toner quantity Td of the toner layer 19 transferred onto the developing roller 3 to the toner quantity Tm of the toner layer 18 on the intermediate roller 4 when the ratio (peripheral velocity ratio K1) of the peripheral velocity $v_{mid}$ of the intermediate roller 4 to the peripheral velocity $v_{dev}$ of the developing roller 3 was varied in the development device 1 according to this embodiment.

It is proved from this result that the ratio Td/Tm is substantially proportional to the peripheral velocity ratio K1 except near the place where the peripheral velocity ratio K1 is 1. Near the place where the peripheral velocity ratio K1 is 1, that is, near the place where the peripheral velocity $v_{mid}$ of the intermediate roller 4 is substantially equal to the peripheral velocity $v_{dev}$ of the developing roller 3, the force with which the developing roller 3 rubs the toner layer 18 on the intermediate roller 4 is weakened to destabilize the transfer of the toner to the developing roller 3.

From the results of FIGS. 4 and 5, in the development device 1 according to this embodiment, the toner quantity Td of the toner layer 19 on the developing roller 3 can be determined as the following expression by the toner quantity Tm of the toner layer 18 on the intermediate roller 4 and the peripheral velocity ratio K1.

$$Td \approx (v_{mid}/v_{dev}) \cdot Tm = K1 \cdot Tm \quad (1)$$

As is apparent from the result of FIG. 5, the peripheral velocity ratio K1 is unstable near 1. The driving torque increases when the value of the peripheral velocity ratio K1 is set to be high. From these facts, the peripheral velocity ratio K1 is set in a range of 1<K1<4 in this embodiment.

In the same manner as the aforementioned indentation between the developing roller 3 and the intermediate roller 4, the indentation between the photoconductor 2 and the developing roller 3 has to be not smaller than 0.1 mm so that an electrostatic latent image on the photoconductor 2 can be developed stably. The driving torque increases likewise when the indentation increases. It is therefore preferable that the indentation between the photoconductor 2 and the developing roller 3 is in a range of 0.1-0.3 mm.

A toner quantity Tpc of the toner layer formed on the photoconductor 2 depends on the aforementioned toner quantity Td of the toner layer 19 on the developing roller 3, a peripheral velocity ratio K2 ($v_{dev}/v_{pc}$) of the peripheral velocity $v_{dev}$ of the developing roller 3 to a peripheral velocity $v_{pc}$ of the photoconductor 2, and the potential difference between the latent image potential of the photoconductor 2 and the voltage applied from the bias power supply 10 to the developing roller 3. A maximum value Tpc(max) of the toner quantity Tpc can be determined as follows.

$$Tpc(\max) \approx (v_{dev}/v_{pc}) \cdot Td = K2 \cdot Td \quad (2)$$

The peripheral velocity ratio K2 is unstable near 1 in the same manner as the aforementioned relationship between the intermediate roller 4 and the developing roller 3. The driving torque increases when the value of the peripheral velocity ratio K2 is set to be high. In this embodiment, therefore, the peripheral velocity $v_{dev}$ of the developing roller 3 is set in the relation of $v_{dev}>v_{pc}$ to the peripheral velocity $v_{pc}$ of the photoconductor 2, and the peripheral velocity ratio K2 is set in a range of 1<K2<2.

When the peripheral velocity ratio K2 is set to be not lower than 1, the rotational velocity of the intermediate roller 4 increases due to the relationship of the aforementioned expression (1) so that the driving torque increases. It is also possible to set the peripheral velocity $v_{dev}$ of the developing roller 3 in the relation of $v_{dev}<v_{pc}$ to the peripheral velocity $v_{pc}$ of the photoconductor 2, and set the peripheral velocity ratio K2 in the relation of K2<1. Specifically in this case, the value of the peripheral velocity ratio K2 can be set in a range of 0.5-0.95.

Figure 6:
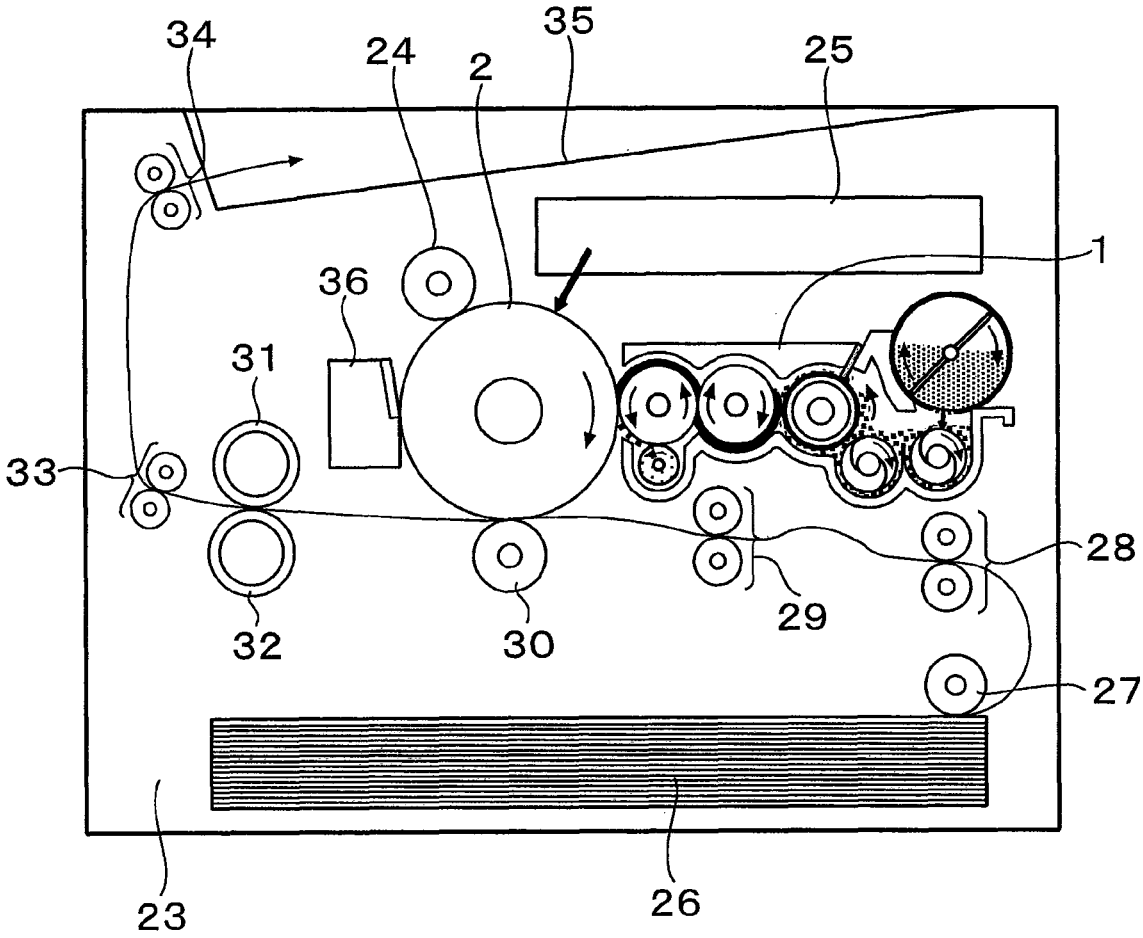
FIG. 6 is a schematic general configuration view of a laser printer to which a development device according to the first embodiment of the present invention has been applied.

FIG. 6 is a schematic general configuration view of an image forming apparatus (laser printer 23) using the development device 1 according to this embodiment.

An organic photoconductor (OPC) is used as the photoconductor 2. The peripheral velocity of the photoconductor 2 is 100-400 mm/sec. The photoconductor 2 is charged to −400 V to −700 V by a charging roller 24. Next, an electrostatic latent image of an image to be printed is formed on the photoconductor 2 by a laser exposure unit 25. At this time, a potential (contrast potential) between a portion exposed by a laser and an unexposed portion is set to be not lower than about 350 V, and the peripheral velocity of the developing roller 3 is set to be about 1-2 times as high as the peripheral velocity of the photoconductor 2. Further, a developing bias of −80 V to −350 V is applied to the developing roller 3 so as to perform reversal development.

Paper for printing is fed from a paper cassette 26 by a paper feed roller 27, and conveyed to registration rollers 29 by conveyance rollers 28. The paper is conveyed through the registration rollers 29 in sync with the toner image formed on the photoconductor 2. The toner image on the photoconductor 2 is transferred to the paper by a transfer roller 30.

Next, the toner image on the paper is fixed by a fixing unit constituted by a heating roller 31 and a backup roller 32. Further, the paper is conveyed to a delivery tray 35 by conveyance rollers 33 and delivery rollers 34. After transferring, a toner remaining on the photoconductor 2 is cleaned up by a cleaning unit 36, and the photoconductor 2 is subjected to the aforementioned charging, exposing, developing and transferring processes again.

When printing was performed in the aforementioned conditions by the laser printer 23 configured thus, high-speed and high-quality images could be obtained stably over a long time in the image density range of 1.2-1.8 (O.D). Even in long-term printing, the developing roller 3 and the intermediate roller 4 were not worn away conspicuously, and the two rollers were not filmed with any toner.

This depends on the following facts. That is, when a roller made of metal is used as the intermediate roller 4 in the present invention, abrasion with a developer using a magnetic carrier can be reduced. In addition, a toner layer can be stably formed on the developing roller 3 without using any means such as a metal blade which should be brought into contact with the developing roller 3 composed of an elastic body so as to rub the surface thereof.

The relation of $v_{mid}>v_{dev}>v_{pc}$ established among the peripheral velocities of the intermediate roller 4, the developing roller 3 and the photoconductor 2 can also contribute to the stable acquisition of high-speed and high-quality images. On the other hand, the relation of $v_{dev}<v_{mid}<v_{pc}$ established among the peripheral velocities of the intermediate roller 4, the developing roller 3 and the photoconductor 2 can contribute to the stable acquisition of high-speed and high-quality images without increasing driving torque of each roller.

Figure 7:
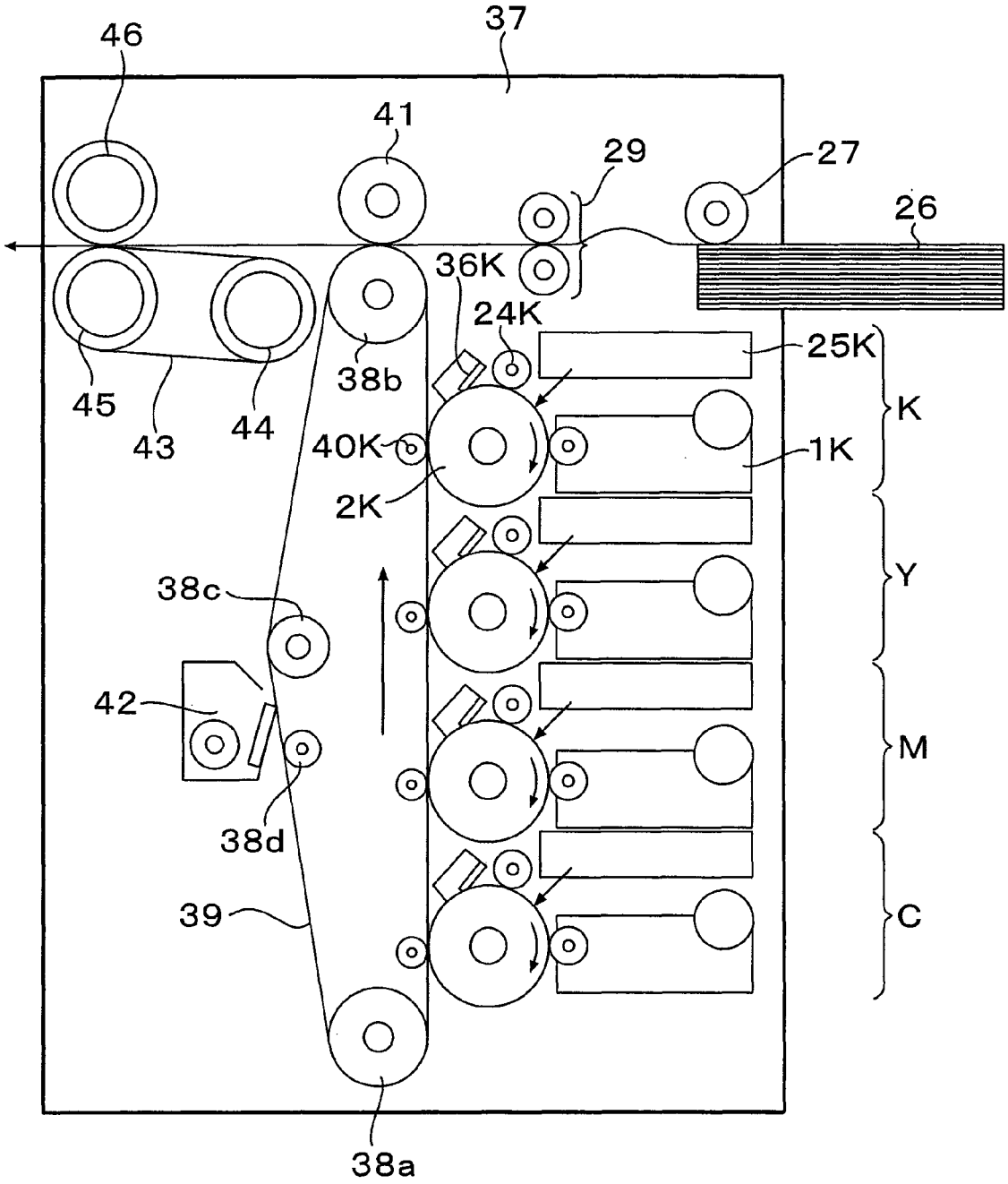
FIG. 7 is a schematic general configuration view of a color laser printer to which development devices according to the first embodiment of the present invention have been applied.

FIG. 7 is a schematic general configuration view of another image forming apparatus (color laser printer 37) using development devices 1 according to the present invention.

In the color laser printer 37, developing units for respective colors are disposed on a side surface of an intermediate transfer belt 39 which is set up by a plurality of belt conveyance rollers 38*a*, 38*b*, 38*c* and 38*d*. On the intermediate transfer belt 39, a color toner image is formed out of toners by the developing units. The color toner image is transferred to paper conveyed from a paper cassette 26. The toners are fused and fixed by heat and pressure in a fixing unit constituted by a fixing belt 43, a heating roller 44, a pressure roller 45 and a backup roller 46. Thus, a color image is formed.

The number of the developing units is four. The four developing units are arranged as a C developing unit loaded with a cyan toner, an M developing unit loaded with a magenta toner, a Y developing unit loaded with a yellow toner, and a K developing unit loaded with a black toner.

Each developing unit has one and the same configuration. Here, the configuration of the K developing unit will be described by way of example. The K developing unit is constituted by a development device 1K, a photoconductor 2K, a charging roller 24K, a laser exposure unit 25K, a first transfer roller 40K for transferring a toner image on the photoconductor 2K to the intermediate transfer belt 39, and a cleaning unit 36K in the same manner as in the first embodiment.

The intermediate transfer belt 39 is set up by a plurality of belt conveyance rollers 38*a*, 38*b*, 38*c* and 38*d*. The intermediate transfer belt 39 is driven and conveyed by the belt conveyance roller 38*b*. A belt cleaner 42 removes toners remaining on the intermediate transfer belt 39. The first transfer rollers 40 are disposed inside the intermediate transfer belt 39 so as to face the photoconductors 2 respectively.

A paper conveyance path leaves the paper cassette 26 with a stack of paper, passes through a paper feed roller 27 and registration rollers 29, runs between a second transfer roller 41 and the intermediate transfer belt 39, and reaches the fixing unit.

To form an image, the surface of the photoconductor 2 is charged by the charging roller 24 and irradiated with light corresponding to the image by the laser exposure unit 25 so that the potential of the irradiated portion on the photoconductor 2 is dropped down. In accordance with the rotation of the photoconductor 2, the irradiated portion reaches the developing roller 3 of the development device 1 and comes into contact with a toner layer. A charged toner adheres to an electrostatic latent image on the photoconductor 2. Next, the toner image on the photoconductor 2 is transferred onto the intermediate transfer belt 39 in the section where the first transfer roller 40 presses the intermediate transfer belt 39.

Toner images on the photoconductors of the respective developing units are transferred onto the intermediate transfer belt 39 so as to form a color toner image. In the section where the second transfer roller 41 is placed, the color toner image is transferred onto paper conveyed by the intermediate transfer belt 39. The paper where the color toner image has been transferred is conveyed to the fixing unit. The toners are fused and fixed by heat and pressure. Thus, a color image is formed.

In this embodiment, high-speed and high-quality color images could be obtained stably over a long time in the image density range of 1.2-1.8 (O.D) of each color image. Even in long-term printing, each developing roller 3 and each intermediate roller 4 were not worn away conspicuously, and the two rollers were not filmed with any toner.

This depends on the following facts. That is, when a roller made of metal is used as the intermediate roller 4 in the present invention, abrasion with a developer using a magnetic carrier can be reduced. In addition, a toner layer can be stably formed on the developing roller 3 without using any means such as a metal blade which should be brought into contact with the developing roller 3 composed of an elastic body so as to rub the surface thereof.

Second Embodiment

Figure 8:
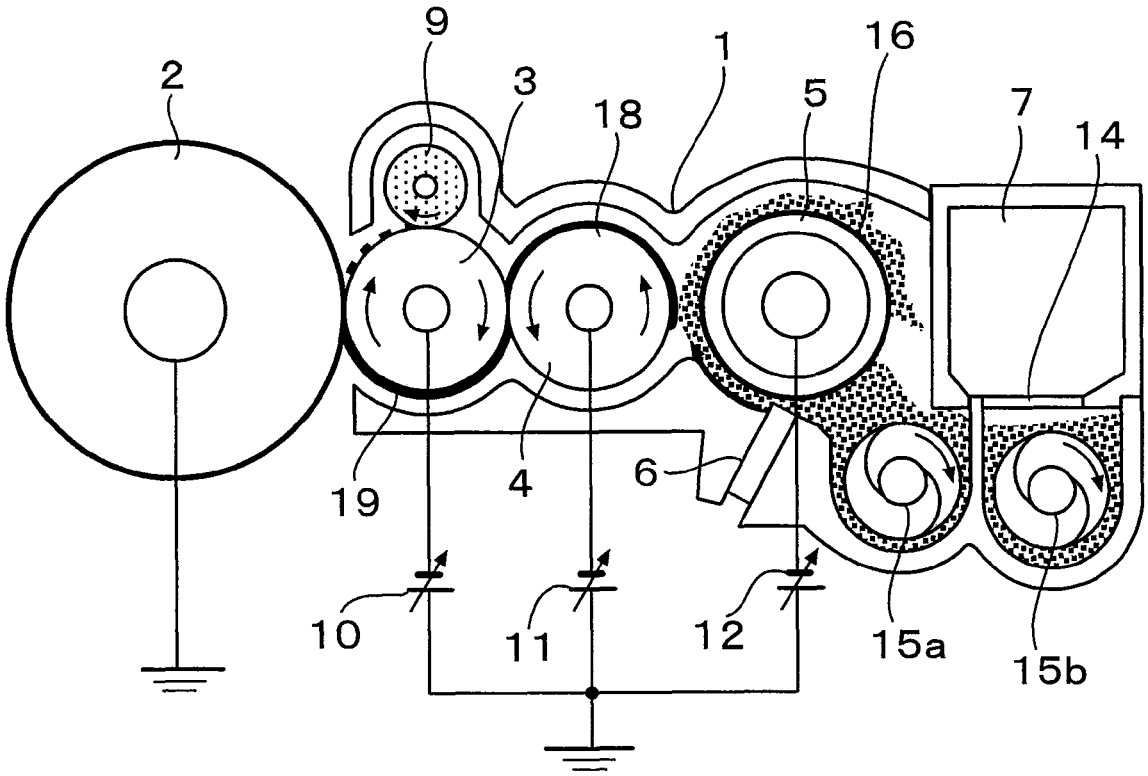
FIG. 8 is a schematic side view of a development device according to a second embodiment of the present invention.

FIG. 8 is a side sectional view of a development device according to a second embodiment of the present invention. The configuration of the development device 1 in FIG. 8 is fundamentally the same as that in the first embodiment, except the rotating direction of the photoconductor 2. That is, the photoconductor 2 rotates clockwise in the first embodiment, but rotates counterclockwise in the second embodiment. Therefore, the developing roller 3, the intermediate roller 4 and the magnetic roller 5 rotate in opposite directions to those in the first embodiment.

Conditions of a toner and a magnetic carrier, set conditions of the control plate 6 and respective rollers, etc. in this embodiment are the same as the conditions described in the first embodiment. Therefore, description will not be made redundantly.

Figure 9:
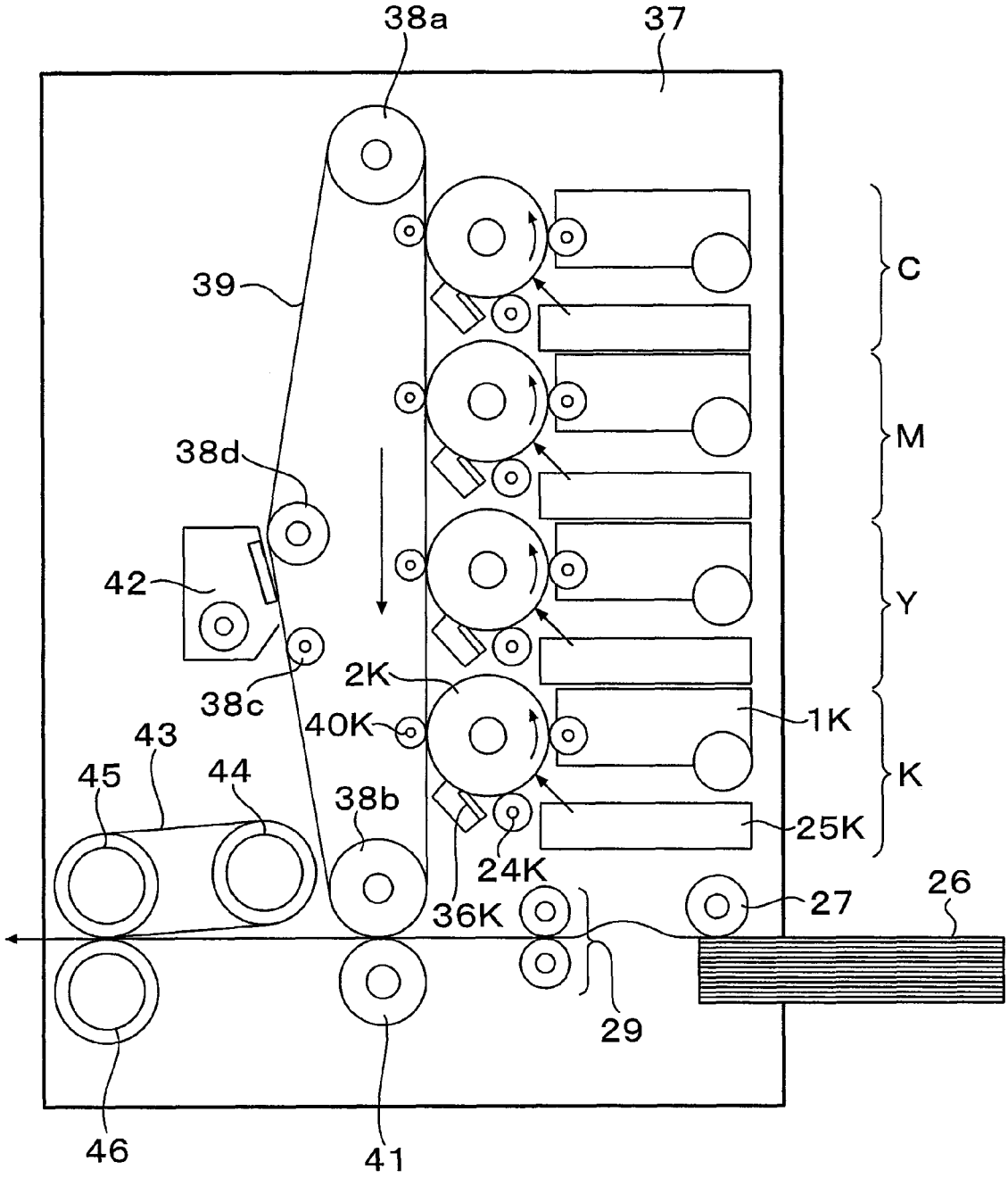
FIG. 9 is a schematic general configuration view of a color laser printer to which development devices according to the second embodiment of the present invention have been applied.

FIG. 9 is a schematic general configuration view of an image forming apparatus (color laser printer 37) using development devices 1 according to the second embodiment.

Configurations and operations of respective members are substantially the same as those of the image forming apparatus described with reference to FIG. 7. However, the conveyance direction of the intermediate transfer belt 39 differs from that in the image forming apparatus described with reference to FIG. 7.

Also in this embodiment, high-speed and high-quality color images could be obtained stably over a long time in the image density range of 1.2-1.8 (O.D) of each color image. Even in long-term printing, each developing roller 3 and each intermediate roller 4 were not worn away conspicuously, and the two rollers were not filmed with any toner.

This depends on the following facts. That is, when a roller made of metal is used as the intermediate roller 4 in the present invention, abrasion with a developer using a magnetic carrier can be reduced. In addition, a toner layer can be stably formed on the developing roller 3 without using any means such as a metal blade which should be brought into contact with the developing roller 3 composed of an elastic body so as to rub the surface thereof.

DESCRIPTION OF REFERENCE NUMERALS

1 . . . development device, 2 . . . photoconductor, 3 . . . developing roller, 4 . . . intermediate roller, 5 . . . magnetic roller, 6 . . . control plate, 7 . . . toner hopper, 8 . . . stirring blade, 9 . . . reset roller, 10,11,12 . . . bias power supply, 13 . . . toner, 14 . . . opening, 15*a*,15*b* . . . developer stirring screw, 16 . . . developer, 17 . . . developer layer, 18,19 . . . toner layer, 20 . . . core, 21 . . . elastic layer, 22 . . . surface layer, 23 . . . laser printer, 24 . . . charging roller, 25 . . . laser exposure unit, 26 . . . paper cassette, 27 . . . paper feed roller, 28 . . . conveyance roller, 29 . . . registration roller, 30 . . . transfer roller, 31 . . . heating roller, 32 . . . backup roller, 33 . . . conveyance roller, 34 . . . delivery roller, 35 . . . delivery tray, 36 . . . cleaning unit, 37 . . . color laser printer, 38*a*,38*b*,38*c*, 38*d* . . . belt conveyance roller, 39 . . . intermediate transfer belt, 40 . . . first transfer roller, 41 . . . second transfer roller, 42 . . . belt cleaner, 43 . . . fixing belt, 44 . . . heating roller, 45 . . . pressure roller, and 46 . . . backup roller.

What is claimed is:

1. A development device comprising:

a binary developer composed of a magnetic carrier and a toner;

a developing roller for applying the toner to an electrostatic latent image formed on a surface of an image carrying member so as to develop the electrostatic latent image, at least a surface layer of the developing roller being made of an elastic body;

an intermediate roller made of metal and disposed closely to the developing roller so as to face the developing roller; and a magnetic roller disposed closely to the intermediate roller so as to face the intermediate roller; wherein:

the magnetic roller is rotated in contact with the binary developer so that a developer layer made of a mixture of the magnetic carrier and the toner is formed on a surface of the magnetic roller;

the developer layer is carried toward the intermediate roller made of metal so that only the toner of the developer layer is transferred to the intermediate roller so as to form a toner layer; and with rotation of the intermediate roller and the developing roller, the toner layer is transferred from the intermediate roller to the developing roller, and the toner layer on the developing roller is brought into contact with the surface of the image carrying member.

2. A development device according to claim 1, wherein irregularities are formed in a surface of at least one of the magnetic roller and the intermediate roller.

3. A development device according to claim 1, further comprising:

a first bias power supply connected to the magnetic roller;

a second bias power supply connected to the intermediate roller; and a third bias power supply connected to the developing roller; wherein:

an electric field acting in a direction in which only the toner of the developer layer formed on the magnetic roller is transferred to the intermediate roller is formed by a potential difference between the first bias power supply and the second bias power supply; and an electric field acting in a direction in which the toner formed on the intermediate roller is transferred to the developing roller is formed by a potential difference between the second bias power supply and the third bias power supply.

4. A development device according to claim 1, wherein a relation of $v_{mid} > v_{dev}$ is established between a peripheral velocity $v_{mid}$ of the intermediate roller and a peripheral velocity $v_{dev}$ of the developing roller.

5. A development device according to claim 1, wherein:

a quantity Tm of the toner is applied onto the intermediate roller, and the intermediate roller is rotated in contact with the developing roller so as to transfer the toner on the intermediate roller to the developing roller, so that a toner layer of a toner deposit quantity Td is formed on the developing roller; and a relation of $Td \approx (v_{mid}/v_{dev}) \cdot Tm$ is established among a peripheral velocity $v_{mid}$ of the intermediate roller, a peripheral velocity $v_{dev}$ of the developing roller and the quantity Tm of the toner applied onto the intermediate roller, so as to obtain the predetermined toner deposit quantity Td on the developing roller.

6. A development device according to claim 1, further comprising:

a control member provided in opposition to a periphery of the magnetic roller so as to control a thickness of the developer layer on the magnetic roller.

7. A development device according to claim 1, wherein indentation of the developing roller on the intermediate roller is controlled to be not shallower than 0.1 mm.

8. An image forming apparatus comprising:

a photoconductor;

a charging unit for charging a surface of the photoconductor uniformly;

an exposure unit for irradiating the charged surface of the photoconductor with light so as to form an electrostatic latent image thereon;

a development device for supplying a toner onto the photoconductor where the electrostatic latent image is formed, so as to develop the electrostatic latent image into a toner image;

a transfer unit for transferring the toner image formed on the photoconductor by the development device to a recording medium; and a fixing unit for fixing the transferred toner image onto the recording medium; wherein:

the development device is a development device according to claim 1.

9. An image forming apparatus according to claim 8, wherein a relation of $v_{dev}>v_{pc}$ is established between a peripheral velocity $v_{dev}$ of the developing roller and a peripheral velocity $v_{pc}$ of the photoconductor.

10. An image forming apparatus according to claim 9, wherein a relation of $v_{mid}>v_{dev}>v_{pc}$ is established among a peripheral velocity $v_{mid}$ of the intermediate roller, the peripheral velocity $v_{dev}$ of the developing roller and the peripheral velocity $v_{pc}$ of the photoconductor.

11. An image forming apparatus according to claim 10, wherein the development device includes a plurality of development units which are loaded with toners of different colors individually, so that a color image can be formed.

12. An image forming apparatus according to claim 9, wherein the development device includes a plurality of development units which are loaded with toners of different colors individually, so that a color image can be formed.

13. An image forming apparatus according to claim 8, wherein a relation of $V_{dev}<V_{pc}$ is established between a peripheral velocity $V_{dev}$ of the developing roller and a peripheral velocity $v_{pc}$ of the photoconductor.

14. An image forming apparatus according to claim 13, wherein a relation of $V_{dev}<V_{mid}<V_{pc}$ is established among a peripheral velocity $v_{mid}$ of the intermediate roller, the peripheral velocity $v_{dev}$ of the developing roller and the peripheral velocity $v_{pc}$ of the photoconductor.

15. An image forming apparatus according to claim 14, wherein in order to obtain a maximum value Tpc(max) of a quantity of the toner applied to the electrostatic latent image on the photoconductor, a relation of $Tpc(max)\approx(v_{dev}/v_{pc})\cdot Td$ is established among the peripheral velocity $v_{dev}$ of the developing roller, the peripheral velocity $v_{pc}$ of the photoconductor and a toner deposit quantity Td on the developing roller.

16. An image forming apparatus according to claim 14, wherein the development device includes a plurality of development units which are loaded with toners of different colors individually, so that a color image can be formed.

17. An image forming apparatus according to claim 13, wherein in order to obtain a maximum value Tpc(max) of a quantity of the toner applied to the electrostatic latent image on the photoconductor, a relation of $Tpc(max)\approx(v_{dev}/v_{pc})\cdot Td$ is established among the peripheral velocity $v_{dev}$ of the developing roller, the peripheral velocity $v_{pc}$ of the photoconductor and a toner deposit quantity Td on the developing roller.

18. An image forming apparatus according to claim 17, wherein the development device includes a plurality of development units which are loaded with toners of different colors individually, so that a color image can be formed.

19. An image forming apparatus according to claim 13, wherein the development device includes a plurality of development units which are loaded with toners of different colors individually, so that a color image can be formed.

20. An image forming apparatus according to claim 8, wherein the development device includes a plurality of development units which are loaded with toners of different colors individually, so that a color image can be formed.

* * * * *